United States Patent [19]

Beskin

[11] Patent Number: 4,482,084

[45] Date of Patent: Nov. 13, 1984

[54] DRESSING DEVICE

[76] Inventor: Gerald S. Beskin, 1401 Pennsylvania NE. #1029-A, Albuquerque, N. Mex. 87110

[21] Appl. No.: 445,352

[22] Filed: Nov. 29, 1982

[51] Int. Cl.[3] ..... A47J 51/06

[52] U.S. Cl. ..... 223/111

[58] Field of Search ..... 223/111, 112, 113, 114

[56] References Cited

U.S. PATENT DOCUMENTS

| | | | |
|---|---|---|---|
| 1,315,096 | 9/1919 | Deiley | 223/111 |
| 2,919,840 | 1/1960 | Hoagland | 223/111 |
| 3,860,156 | 1/1975 | Lawrence | 223/111 |

*Primary Examiner*—Robert R. Mackey

*Attorney, Agent, or Firm*—Kinney & Lange

[57] ABSTRACT

A device for remotely pulling on and removing nether garments comprising a pair of grabber arms that each have curved inner and outer jaws between which the garment top is spread and clamped. Clamping of the jaws is accomplished remotely by means of a cable connected to the jaws and to a handle through an extension shaft. A fulcrum-assist release lever and crescent shaped hook in the handle act as an eccentric and provide clamping action by pulling the outer jaws to the inner jaws under mechanically amplified power. Once spread and clamped, the garment is opened and pulled over a foot by pulling the handles or shafts up both sides of the leg.

10 Claims, 7 Drawing Figures

DRESSING DEVICE

DESCRIPTION

1. Field of the Invention

This invention relates to a device for pulling on and removing nether garments, especially for individuals with handicaps making ordinary manual practices difficult.

2. Description of Prior Art

Individuals suffering from a variety of infirmities find it difficult, if not impossible, to apply and remove garments below their waist. People with back injuries, obesity or those merely feeling the effects of old age cannot readily reach their feet. Such individuals necessarily have difficulty in removing and putting on their undergarments, socks, hosiery and other nether garments. The required movements of the body in pulling on and taking off such garments often cannot be performed without an assisting device or services of a second individual.

Various devices for aiding a person in placing a stocking or other garment on or over their foot are known in the art. These devices usually employ a handle with an elongated shaft and an end with grippers or clamping means. These devices have typically been very cumbersome, difficult to travel with and uncomfortable to use and often result in many torn or ruined garments due to their clamping action.

BRIEF SUMMARY OF THE INVENTION

The highly compact dressing device of the invention consists of two grabber arms that each include an elongated shaft to give the individual a greater reach without bending, a clamping mechanism to hold the garment top open and a handle which includes a mechanism to remotely clamp and set as well as release the garment from the clamping end. The clamping ends include an inner crescent shaped jaw attached to the shaft and an outer crescent shaped jaw whose concave surface matches the convex surface of the inner crescent jaw. The outer jaw is hingedly mounted to the inner jaw and held apart from the inner jaw by a compression spring. A cable attached to the outer jaw passing through the hollow shaft to the handle is used to counter the spring pressure, thereby clamping and setting the outer jaw to the inner jaw.

The handle on each shaft includes a release lever pivotally attached to the handle body and a crescent hook which is attached to the cable from the outer jaw. The release lever and crescent hook cooperate as an eccentric pulling the cable which clamps the outer and inner jaws together with approximately fifty pounds pressure per square inch.

In operation, the top of the garment is simultaneously stretched over the juxtaposed inner crescent jaws of the grabber arms. The two inner crescent jaws define an ovular opening and are held in place by alignment dimples and nodules. The handles of the two grabber arms are temporarily held together by a swivel pivot to allow the individual to first stretch the garment and then set shafts at the clamping ends to accommodate his foot. To do so, the operator flips the levers on each handle, clamping each side of the garment to a pair of crescent jaws. The swivel pivot is released to separate the handles, and the operator pulls the garment over his foot, wiggling the grabber arms as needed to assist pulling the garment over the foot. The garment is also held fast to the clamping jaws by the snubbing action of the matching tongue and groove on the matching crescent jaw surfaces.

The device is released from the garment by moving the handle lever, and the springs open the jaws so that the device can be removed from the garment top. The crescent shape of the jaws provide an ovular opening through which a foot and ankle can easily pass.

Removing a garment is accomplished by clamping a grabber arm on each side of the garment while on the leg or hip. The operator merely exerts a downward force on the shafts until the garment is peeled from the leg and foot.

The device of the invention transfers the normal garment gripping action of the hands to the grabber arms, giving remote control to the operator. The device can be used to both put on and remove garments of clothing below the waist. The remote clamping and release of garments is quickly and easily done by virtue of the combined designs of the grabber arms. Individuals avoid the severe bending and contortions that are normally associated with manual methods of applying and removing garments by virtue of the extended reach of the invention.

The shape of the inner crescent jaws define an opening that conforms to the human foot and leg, eliminating any pain in dressing due to a poorly fitted device. Also, the invention does not damage garment fabric due to the unique design of the clamping ends. The device of the invention is well suited to any garment that must be pulled past the human foot, including stockings, hosiery, pajama bottoms, underwear and other nether garments.

BRIEF DESCRIPTION OF THE DRAWINGS

A detailed description of one preferred embodiment of my invention is hereafter described with specific reference being made to the drawings in which.

DETAILED DESCRIPTION OF THE INVENTION

Figure 1:
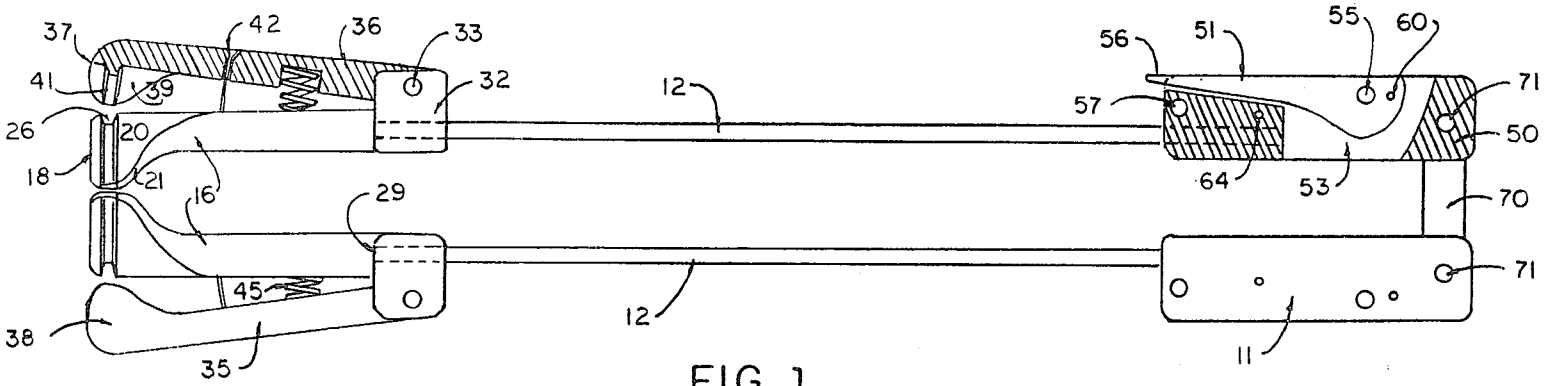
FIG. 1 is a side view of the grabber arms of the invention linked together, with portions of an outer jaw and handle cut away.
Figure 2:
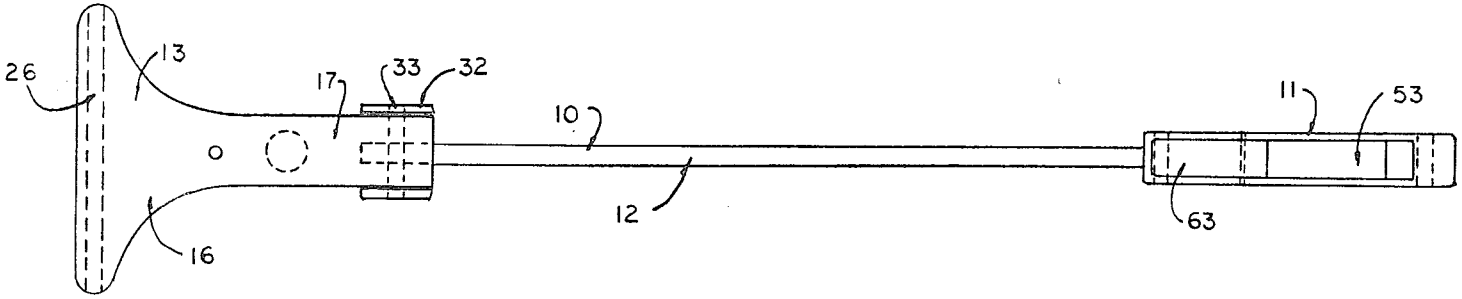
FIG. 2 is a top view of the grabber arm of the invention.

The dressing device consists of right and left grabber arms 10 which are preferably identical in construction. FIGS. 1 and 2 show grabber arms 10 of the dressing device. Grabber arms 10 consist of handle 11, elongated shaft 12, grabber jaws 13 and cable 14.

Figure 4:
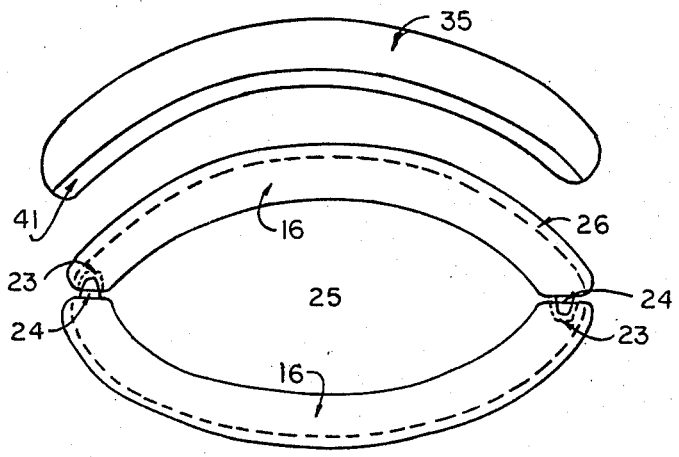
FIG. 4 is an end view of matching inner crescent jaws and an outer crescent jaw.

Grabber jaws 13 consist of inner jaw 16 with narrow neck 17 and crescent shaped jaw 18 with convex and concave surfaces 20, 21, respectively. At each end of crescent shaped jaw 18 is on aligment nodule 23 and a dimple 24 constructed such that, when right and left grabber arms 10 are positioned with concave surfaces 21 facing each other, alignment nodules 23 rest in alignment dimples 24. As shown in FIG. 4, opening 25 is thus defined by the alignment of the inner jaws through which a foot can easily pass. All of the edges are preferably rounded to avoid abrading the skin.

Crescent shaped jaw 18 includes slotted groove 26 running laterally to neck 17 on convex surface 20. Neck 17 is attached to hollow shaft 12. Cable guide 28 passes through convex surface 20 of inner jaw 16 through neck 17, communicating with lumen 29 of hollow shaft 12. Preferably, preformed metal tube 30 is inserted into cable guide 28 to provide a longer lasting wear surface against which the cable slides.

Inner jaw 16 includes hinge 32 at the neck end to which outer jaw 35 is pivotally mounted to its neck 36. Outer jaw 35 includes crescent shaped jaw 37 with convex and concave surfaces 38, 39, which match the curvature of inner jaw 16. The curvatures are such that the outer crescent shaped jaw 37 mates or meshes with inner crescent shaped jaw 18 along the curved arcs formed. This mating allows a garment to be held snubbed along the entire arc and decreases stress points and fabric damage. Crescent shaped jaw 37 includes raised tongue 41 on concave surface 39 which meshes with slotted groove 26 of inner jaw 16.

Figure 3:
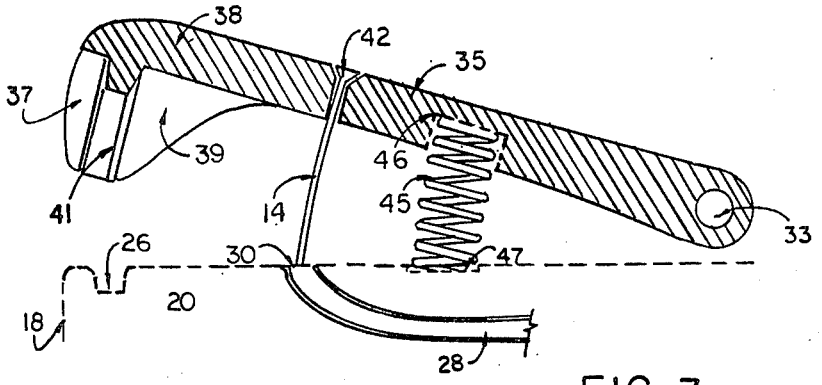
FIG. 3 is an enlarged view of an outer and inner crescent jaw of FIG. 1.

Cable 14 is rigidly mounted to outer jaw 35 through connection 42 which may be a brazed brass end on the cable. Cable 14 passes through cable guide 28 and shaft 12. As shown in FIG. 3, compression spring 45 between outer crescent jaw seat 46 and inner crescent jaw seat 47 forces crescent shaped jaws 18 and 37 to separate while hinge 32 and dowel 33 cause necks 17 and 36 to pivot relative to each other.

Figure 5:
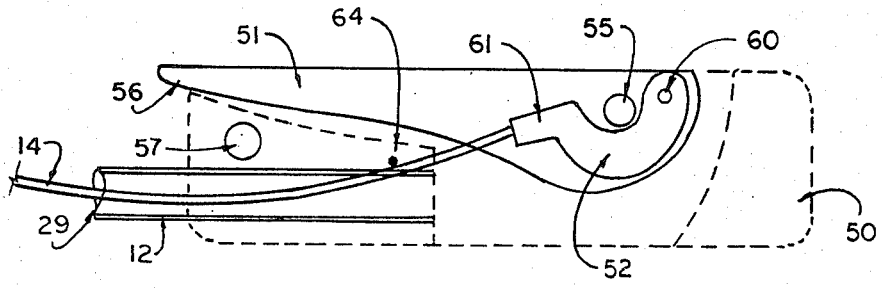
FIG. 5 is a side view of the handle showing the release lever and crescent hook, with part of the handle and body cut away.
Figure 7:
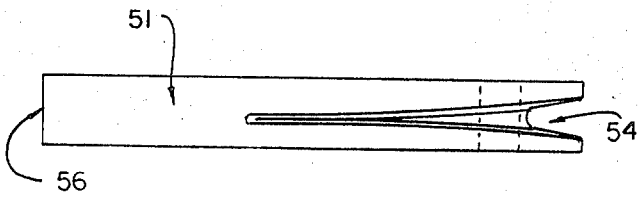
FIG. 7 is a bottom view of the release handle lever showing the cable travel slot.

Shaft 12 is formed of a hollow tube of rigid inflexible material, such as products sold under the trademark FIBERGLAS sold by Owens-Corning Fiberglas Corp. of Toledo, Ohio, aluminum or steel tubing. Neck 17 of inner jaw 16 is attached to one end of shaft 12. At the other end of shaft 12, handle 11 is attached, including handle body 50, release lever 51 and crescent hook 52. Handle body 50 and grabber arms 13 are preferably molded or machined of plastic, such as the methyl methacrylate polymers sold under the trademark PLEXIGLAS by Rohm and Haas Company of Philadelphia, Pa., to include opening or recess 53 as shown in FIGS. 2 and 5. Release lever 51 sits within recess 53 attached by pivot 55 to handle body 50. End 56 of release lever 51 preferably extends beyond handle body 50 when lever 51 is within recess 53 so the operator can easily grasp lever 51. Dowel or pin 57 is preferably used as a stop point in handle body 50 to prevent release lever 51 from fitting too deeply into recess 53 to facilitate removal by an operator. Release lever 51 has slot 54 to allow cable 14 travel as shown in FIG. 7.

Crescent hook 52 is attached to release lever 51 through pivot 60 near release lever pivot 55, such that hook 52 acts as an eccentric. End 61 of crescent hook 52 is attached to the free end of cable 14 which passes through shaft 12 from outer jaw 35. Slot 63 is formed in shaft 12 at the handle end to allow free travel of the cable to crescent hook 52. Cable wear point dowel 64 of brass or other wear resistant material may be provided in handle body 50 to prevent cable 14 from rubbing against handle body 50.

To combined designs of handle body 50, recess 53, release lever 51 and crescent hook 52 are such that, when release lever 51 sits within recess 53, tension is put on cable 14. The cable is preferably relatively non-resilient such that the tension overcomes the force exerted by compression spring 45 and thereby clamps inner jaw 16 to outer jaw 35, preferably with about 50 pounds pressure per square inch. When protruding end 56 of release lever 51 is pulled out from handle body 50, the eccentric acts to relieve tension on cable 14 allowing spring 45 to separate inner jaw 16 from outer jaw 35.

Figure 6:
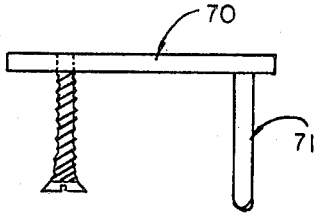
FIG. 6 is a side view of the handle alignment link.

In operation, two grabber arms 10 are used cooperatively. Handle alignment link 70, shown in FIGS. 1 and 6, is attached to one grabber arm 10 to handle body 50, and pin 71 is inserted into a hole in handle body 50 of the second grabber arm. Link 70 is constructed so as to align the handles together and act as a swivel. Both concave surfaces 21 of the two inner jaws 16 face each other, and alignment dimples 24 and nodules 23 hold grabber jaws 13 together defining opening 25.

By way of example, a sock is pulled over convex surfaces 20 of inner jaws 16, thereby opening the top of the sock with grabber arms 10 joined together by handle alignment link 70. Both shafts 12 are then pulled apart, stretching the sock material to provide a greater opening for the foot. Clamping the sock material before stretching would seize the material weave and would not allow it to spread afterwards. The sock could not then be spread wide enough to pass over the foot. Release levers 51 are pushed into recesses 53 which pulls cables 14 taut and clamps inner jaws 16 to outer jaws 35. The approximately fifty pound per square inch pressure exerted and snubbing action of tongue and groove hold the sock in place, and tongues 41 and matching grooves 26 prevent the sock from slipping down and off the device when pulled over an operator's foot.

Once the sock is stretched and clamped as indicated, handle alignment link 70 is detached form one of the grabber arms 10 by removing pin 71. Both grabber arms 10 are then free at the handle body ends. The operator then grasps both grabber arms at the shafts or handles and positions the sock opening over his foot. The sock is pulled onto the foot by pulling up on the grabber arms which can then be wiggled to facilitate the operation. Individuals with immobile or motion impaired feet cannot supply the necessary wiggling by moving their feet, but must rely on motion achieved through the grabber arms. Release levers 51 are then opened to release the clamps when the sock is in position.

Removal of socks or any nether garment is easily accomplished by slipping the garment top over each inner jaw 16 and clamping the garment top between inner jaws 16 and outer jaws 35 by throwing release lever 51. Downward pressure on grabber arms 10 rolls the garment from the operator's leg and foot. The operator at no time is required to reach his foot.

It has been found than an overall device length of approximately eighteen inches and an opening of approximately four inches in diameter, as defined by the grabber jaws, is adequate for most people. However, any scale up or scale down of the device may be made to compensate for children or very large adults. The construction materials of choice are either as indicated or may be made of any material which preferably should be light in weight so the operator need not struggle with a heavy device.

I claim:

1. An apparatus for remotely pulling on and removing garments comprising:

a pair of elongated shafts each having an upper and lower end;

clamping means including open biased inner and outer crescent shaped jaws lateral to said shafts and hingedly mounted to each other, said jaws each having convex and concave surfaces, the convex surface of said inner jaw meshing with the concave surface of said outer jaw, said clamping means defining an opening through which a human foot may pass when the concave surfaces of said inner jaws are aligned to face each other, said inner jaws being rigidly fixed to said shafts; and handle means attached to said shaft upper ends, including means attached to the outer jaws of said clamping means to remotely open and close the jaws of said clamping means.

2. The apparatus of claim 1 wherein said handle means includes means to movably link said handle means to each other such that said clamping means defines an opening through which a human foot may pass.

3. The linking means of claim 2 wherein said link means pivotally connects said handle means to each other such that said clamping means may be moved toward and away from each other by movement of said shafts.

4. The apparatus of claim 3 wherein said handle means includes a release lever, a crescent shaped hook attached to the hook and said release lever and a cable means attached to the pivotal outer jaw of said clamping means, the hook acting as an eccentric tightening and releasing tension on said cable and clamping means.

5. An apparatus for pulling on and removing nether garments comprising:

a pair of elongated hollow shafts, each having an upper and lower end;

clamping means attached to said shaft lower ends and including inner and outer crescent shaped jaws lateral to said shafts and hingedly mounted to each other, said jaws each having convex and concave surfaces, the convex surface of said inner jaw meshing with the concave surface of said outer jaw and defining an opening through which a foot may pass when the concave surfaces of said inner jaws face each other, said inner jaws being rigidly fixed to said shafts;

cable means attached to said outer jaws passing through a lumen of said shafts to said shaft upper ends such that the outer jaws may be clamped to the inner jaws by applying tension to said cable means;

handle means attached to the upper end of said shafts, including a crescent hook and release lever, said crescent hook being attached to said cable means and pivotally mounted to the release lever such that the hook and lever act as a fulcrum-assisted eccentric tensioning and releasing said cable means; and means to releasably link said handle means together such that said inner jaw concave surfaces face each other.

6. The apparatus of claim 5 wherein a compression spring normally biases said outer jaw away from said inner jaw until tension is applied to said cable means through said handle means.

7. The apparatus of claim 6 wherein said inner jaws are aligned with each other by interlocking nodules and dimples.

8. The apparatus of claim 7 wherein said inner jaw convex surface and said outer jaw concave surface includes matching tongue and grooves.

9. An apparatus for remotely donning and removing socks comprising:

means for clamping the top of a sock at a first location, said means including inner and outer crescent shaped jaws pivotally mounted to each other, said jaws having convex and concave surfaces, the convex surface of said inner jaw meshing with the concave surface of said outer jaw;

means for clamping the sock top at a location opposing said first location, said means including inner and outer crescent shaped jaws pivotally mounted to each other, said jaws having convex and concave surfaces, the convex surface of said inner jaw meshing with the concave surface of said outer jaw;

a shaft extending from each clamping means;

handle means attached to the other ends of said shafts for remotely releasing said clamping means;

means detachably joining said handle means to each other; and means for aligning the concave surface of said inner jaws of said clamping means with each other such that an opening is defined between said clamping means through which a human foot may pass.

10. A sock puller comprising:

means for clamping the top of a sock at a first location, said means including inner and outer crescent shaped jaws pivotally mounted to each other, said jaws having convex and concave surfaces, the convex surface of said inner jaw meshing with the concave surface of said outer jaw;

means for clamping the sock top at a location opposing said first location, said means including inner and outer crescent shaped jaws pivotally mounted to each other, said jaws having convex and concave surfaces, the convex surface of said inner jaw meshing with the concave surface of said outer jaw;

an elongated shaft extending from each clamping means;

handle means attached to the ends opposed to said clamping means;

said handle means including a means to remotely activate and deactivate said clamping means;

means for detachably joining said handle means to each other; and means for aligning said clamping means with each other such that an opening is defined between the inner jaws of said clamping means through which a human foot may pass.

* * * * *